United States Patent [19]

Kato

[11] Patent Number: 4,896,644

[45] Date of Patent: Jan. 30, 1990

[54] SYSTEM AND METHOD FOR CONTROLLING A FUEL SUPPLY TO AN INTERNAL COMBUSTION ENGINE

[75] Inventor: Hirohisa Kato, Kanagawa, Japan

[73] Assignee: Nissan Motor Co., Ltd., Japan

[21] Appl. No.: 150,258

[22] Filed: Jan. 29, 1988

[30] Foreign Application Priority Data

Jan. 30, 1987 [JP] Japan ..... 62-21365

[51] Int. Cl.[4] ..... F02D 41/10

[52] U.S. Cl. ..... 123/492; 123/493

[58] Field of Search ..... 123/492, 493

[56] References Cited

U.S. PATENT DOCUMENTS

| | | | |
|---|---|---|---|
| 4,327,682 | 5/1982 | Harada | 123/493 X |
| 4,342,230 | 8/1982 | Okamura et al. | 73/702 |
| 4,395,984 | 8/1983 | Yamaguchi et al. | 123/325 |
| 4,452,212 | 6/1984 | Takase | 123/326 X |
| 4,505,248 | 3/1985 | Yuzawa et al. | 123/519 |
| 4,508,087 | 4/1985 | Yasuoka et al. | 123/493 |
| 4,589,389 | 5/1986 | Kosuge et al. | 123/326 |

FOREIGN PATENT DOCUMENTS 55-125335 9/1980 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

A system and method for controlling a fuel supplied to an internal combustion engine having a fuel supply cut-off function which operates when the engine falls in a predetermined engine deceleration condition. When a fuel supply recovery is restarted immediately after the fuel supply cut-off, a residual quantity of fuel which remains on a wall of an intake air passage is estimated on the basis of an engine load immediately before the fuel supply cut-off is carried out, a fuel recovery increment quantity for incrementing the fuel supply to the engine at a time immediately after the fuel supply recovery is carried out is set on the basis of the estimated residual quantity of fuel and an interval of time for which the fuel supply cut-off is carried out, a basic fuel quantity determined according to an engine operating condition is corrected according to the fuel recovery increment quantity, and the corrected fuel quantity is finally supplied to the engine during the fuel supply recovery. Therefore, a response to an acceleration is remarkably improved due to the fuel recovery increment quantity determined with the residual fuel quantity taken into account.

19 Claims, 5 Drawing Sheets

SYSTEM AND METHOD FOR CONTROLLING A FUEL SUPPLY TO AN INTERNAL COMBUSTION ENGINE

BACKGROUND OF THE INVENTION (1) Field of the Invention

The present invention relates to a system and method for controlling a fuel supply to an internal combustion engine having a fuel supply cut-off function which exhibits during a predetermined engine deceleration condition.

(2) Background of the Art

It is generally necessary to supply an appropriate amount of fuel to the engine according to an outstanding engine operating condition when a supply of fuel to the engine is resumed (a fuel supply cut-off is released, so called, recovery of fuel supply) upon completion of the fuel supply cut-off in order to maintain a driveability of a vehicle in which the engine is mounted.

A Japanese Patent Application First Publication (Tokkai) sho 55-125335 published on Sept. 27, 1980 exemplifies a previously proposed fuel supply controlling system applied to the engine.

In the above-identified Japanese Patent Application Publication, the fuel supply controlling system detects an intake air quantity per revolution of the engine as an engine load, calculates a basic fuel injection quantity according to the intake air quantity, and injects fuel whose quantity corresponds to the basic fuel injection quantity at a predetermined fuel injection timing synchronized with the engine revolution into a vicinity of an intake port of the engine.

In addition, the previously proposed system cuts the fuel supply off when the engine revolution speed is reduced from a high speed range to a low speed range (fuel supply cut-off) so as to drive the engine with a negative torque due to a running inertia force of a vehicle in which the engine and system are mounted, thus preventing the generation of uncombusted fuel and increasing a fuel saving.

When the engine revolution speed is reduced to a predetermined fuel recovery speed (an engine revolution speed at which the fuel supply cut-off is released and the resumption of fuel injection is carried out), the fuel injection is immediately restarted irrespective of the predetermined injection timing so as to generate a positive engine torque. In this case, to avoid a torque variation at the time of fuel recovery due to a difference between the output of an intake air quantity sensor and air quantity actually supplied into each combustion chamber of the engine, the quantity of fuel supply at the time of fuel recovery (recovery fuel quantity) is appropriately corrected with a predetermined correction coefficient.

Furthermore, at the initial stage of fuel recovery, when the fuel cut-off interval exceeds a predetermined value of time, a constant quantity (a fuel recovery increment quantity) of fuel other than the above-described fuel quantity irrespective of the fuel cut-off is supplied to the engine (normally corresponds to a quantity of injection by one pulse) so that the vehicle driveability is maintained.

However, there is a problem in the above-described previously proposed fuel supply controlling system.

That is to say, since the fuel recovery increment quantity at the time of fuel recovery is constant irrespective of the engine operating condition and the system determines the presence or absence of the fuel increment quantity at the time of fuel recovery on the basis of only the interval of time during which the fuel supply cut-off is carried out, the vehicle driveability becomes worsened due to an influence of the non-negligible presence of a residual quantity of fuel remaining on a wall of the intake air passage of the engine and not always providing a most appropriate state of combustion at the time of fuel recovery.

For example, air-fuel mixture ratio in the engine becomes excessively rich when the above-described residual quantity of fuel increases. On the other hand, as the above-described residual quantity of fuel is reduced, the air-fuel mixture ratio becomes lean when fuel recovery is started. Therefore, the effect of improvement in an acceleration response characteristic of the vehicle is insufficient in the case of the above-described fuel supply controlling system.

In addition, the above-described problem causes reductions of exhaust emission effect and fuel economy.

In this way, a better improvement in the acceleration response characteristic needs to be achieved since in the previously proposed system a condition of the engine before the fuel supply cut-off is carried out (for example, the residual quantity of fuel remaining onto the intake air passage) is not taken into consideration upon determination of fuel recovery increment quantity.

SUMMARY OF THE INVENTION

It is therefore an object of the present invention to provide a system and method for controlling fuel supply to an internal combustion engine which enhance an acceleration response characteristic and improve a driveability, exhaust gas emission, and fuel saving.

The above-described object can be achieved by providing a system for controlling a fuel supply to an internal combustion engine, comprising: (a) first means for monitoring engine operating conditions; (b) second means for determining whether the engine presently falls in a predetermined engine deceleration condition on the basis of the engine operating conditions monitored by the first means and cutting off the fuel supply to the engine when determining that the engine presently falls in the predetermined deceleration condition; (c) third means for calculating a basic fuel quantity to be supplied to the engine on the basis of the engine operating conditions monitored by the first means and correcting the basic fuel quantity according to a fuel recovery increment quantity when a recovery of the fuel supply is started after the fuel supply cut-off is carried out by the second means so as to derive a final fuel quantity supplied to the engine; (d) fourth means for calculating an engine load immediately before the fuel supply cut-off is carried out from the engine operating conditions monitored by the first means; (e) fifth means for counting a first duration of time during which the fuel supply cut-off is carried out; (f) sixth means for deriving a residual fuel quantity remaining on a wall of an intake air passage at a time immediately before the fuel supply cut-off is started on the basis of the engine load immediately before the engine fuel cut-off is carried out calculated by the fourth means; (g) seventh means for deriving and setting the fuel recovery increment quantity on the basis of the residual fuel quantity and the first duration of time counted by the fifth means; and (h) eighth means for supplying the final fuel quantity derived by the third means to the engine.

The above-described object can also be achieved by providing a system for controlling a fuel supply to an internal combustion engine, comprising: (a) first means for detecting engine operating conditions; (b) second means for commanding a fuel supply cut-off during a predetermined deceleration condition derived on the basis of the engine operating conditions detected by the first means; (c) third means for calculating a basic fuel injection quantity to be supplied to the engine on the basis of the engine operating conditions detected by the first means, cutting off the fuel supply to the engine upon receipt of the command from the second means, and correcting the basic fuel injection quantity according to a fuel recovery increment quantity when the fuel supply recovery is started after the fuel supply cut-off is carried out to derive a final fuel quantity supplied to the engine; (d) fourth means for calculating an engine load immediately before the fuel supply cut-off is carried out from the engine operating conditions detected by the first means; (e) fifth means for counting a first number of engine revolutions derived on the basis of the engine operating conditions detected by the first means, the first number of engine revolutions representing a duration of time during which the fuel supply cut-off is carried out; (f) sixth means for estimating and calculating a residual quantity of supplied fuel remaining onto a wall of an intake air passage of the engine at a time immediately before the fuel supply cut-off is carried out on the basis of the engine load calculated by the fourth means; (g) seventh means for setting the fuel recovery increment quantity on the basis of the calculated residual quantity remaining onto the intake air passage and the first number of engine revolutions during which the fuel supply cut-off is carried out; and (h) eighth means for supplying the final fuel injection quantity derived by the third means to the engine.

The above-described object can also be achieved by providing a method for controlling a fuel supply to an internal combustion engine, comprising the steps of: (a) monitoring engine operating conditions; (b) cutting off a fuel supply during a predetermined engine deceleration condition derived on the basis of the engine operating conditions monitored in the step (a); (c) calculating a basic fuel quantity to be supplied to the engine on the basis of the engine operating conditions detected in the step (a); (d) deriving an engine load immediately before the fuel supply cut-off is carried out from the engine operating conditions detected in the step (a); (e) estimating a residual quantity of fuel remaining onto the wall of the intake air passage of the engine at a time immediately before the fuel supply cut-off is carried out on the basis or the engine load derived in the step (d); (f) setting a fuel recovery increment quantity to be supplied to the engine after the fuel supply cut-off is carried out on the basis of the residual quantity of fuel and interval of time for which the fuel supply cut-off is carried out in the step (b); (g) correcting the basic fuel quantity according to the set fuel recovery increment quantity to derive a final fuel quantity supplying to the engine; and (h) supplying the final fuel quantity derived in the step (g) to the engine through fuel supplying means.

DETAILED DESCRIPTION OF THE PREFERRED EMBODIMENT

Reference will hereinafter be made to the drawings in order to facilitate understanding of the present invention.

Figure 1:
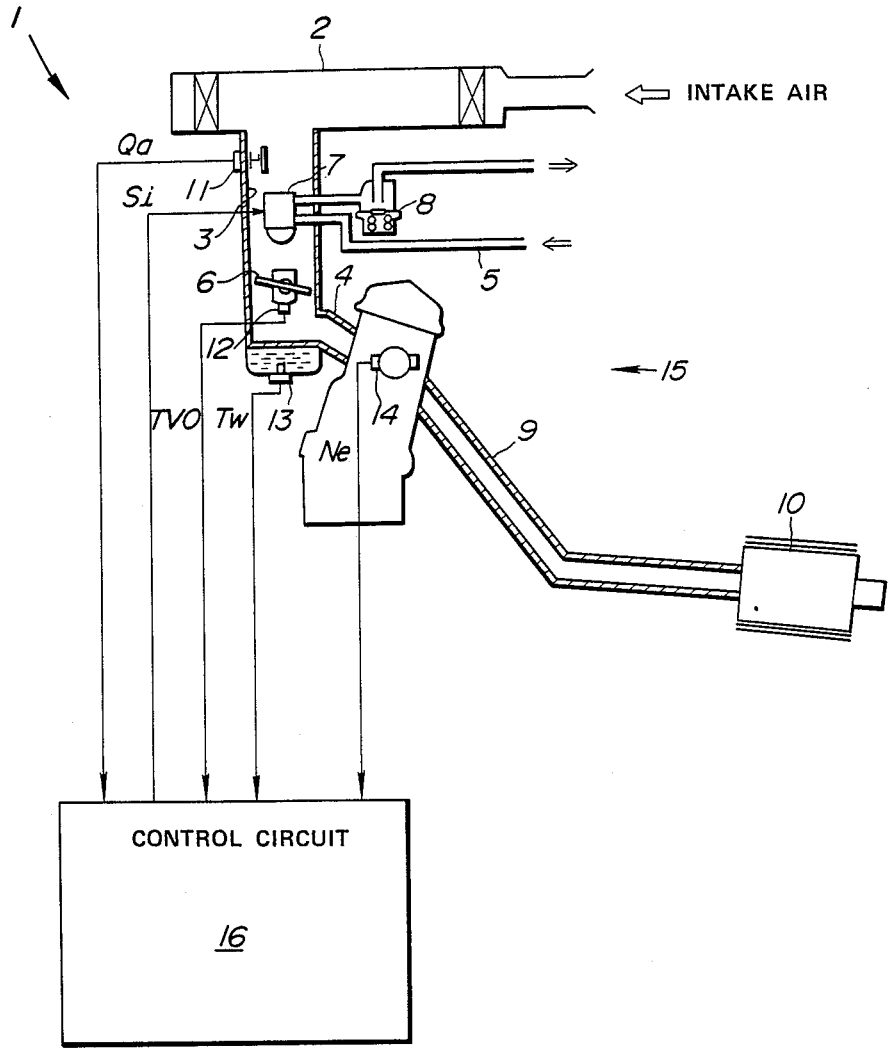
FIG. 1 is a simplified configuration of a fuel supply controlling system according to the present invention.

FIG. 1 shows a configuration of a fuel supply controlling system in a preferred embodiment according to the present invention which is applicable to an internal combustion engine of a single point injection type (a single fuel injector supplies fuel once at a time to all cylinders in the engine).

In details, an engine 1 has a throttle chamber 3 downstream of an air cleaner 2 and branched passage of an intake manifold 4. Each engine cylinder of the engine 1 receives intake air via the corresponding branched passage of the intake manifold 4. The single fuel injector 7 injects fuel into an intake air passage upstream of a throttle valve 6 installed in the throttle chamber 3 in response to an injection signal Si whose pulsewidth is determined as will be described later. The fuel supplied to the injector 7 is derived form a fuel tank (not shown) via a fuel pump (not shown) and a fuel supply tube 5. The fuel supplied to the injector 7 is returned to the fuel tank via a pressure regulation valve 8. A fuel pressure acted upon the fuel injector 7 receives pressure of intake air in the throttle chamber 3 to provide a regulated pressure having a predetermined value.

An air mixture fuel supplied to each cylinder is ignited, burned, and exhausted by means of a discharge action of a spark plug installed in the corresponding combustion chamber thereof and the exhausted gas is exhausted from a muffler 10 via an exhaust passage 9.

An intake air quantity Qa of the intake air passage supplied to the engine 1 is detected by means of an air flow meter of a hot wire type and is controlled by means of the throttle valve 6 in the throttle chamber 3.

The intake air quantity detecting air flow meter of the hot wire type is exemplified in U.S. Pat. No. 4,505,248, the disclosure of which is hereby incorporated by reference.

An opening angle TVO of the throttle valve 6 is detected by means of a throttle valve opening sensor 12 and a temperature of a cooling water of the engine 1 is detected by means of a water temperature sensor 13.

In addition, an angular displacement of a crankshaft Ca of the engine 1 is detected by means of a crank angle sensor 14 and an engine revolution speed Ne is calculated by counting pulses representing the angular displacement of the crankshaft Ca per time derived from the crank angle sensor 14.

Output signals from these sensors 11, 12, 13, and 14 are supplied to a control circuit 16.

The control circuit 16 includes a microcomputer having a CPU (Central Processing Unit), ROM (Read Only Memory), RAM (Random Access Memory), and I/O (Input/Output) Unit. The control circuit 16 calculates processed values required for the fuel supply control in accordance with programs stored in a memory, e.g., the ROM and outputs the injection signal Si to the fuel injector 7.

Next, an operation of the fuel supply controlling system in the preferred embodiment will be described below.

Figure 2:
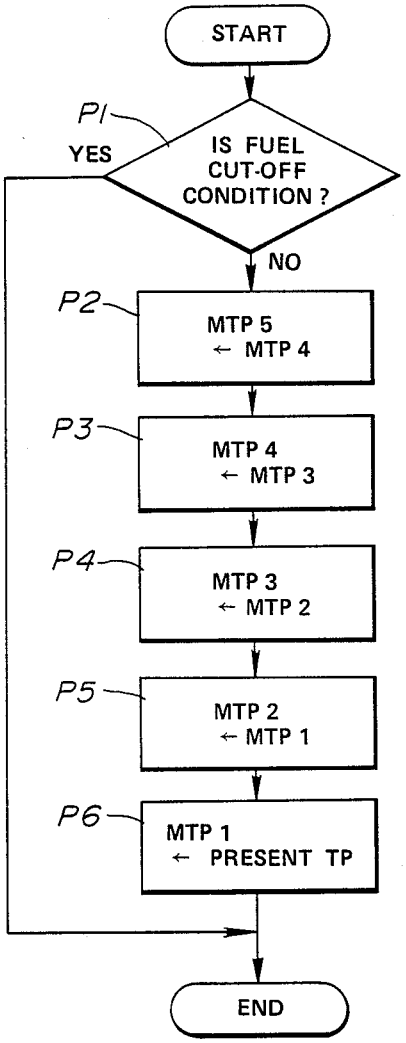
FIG. 2 is a processing flowchart of a program for calculating and storing a basic fuel injection quantity Tp executed in a control circuit shown in FIG. 1.
Figure 4:
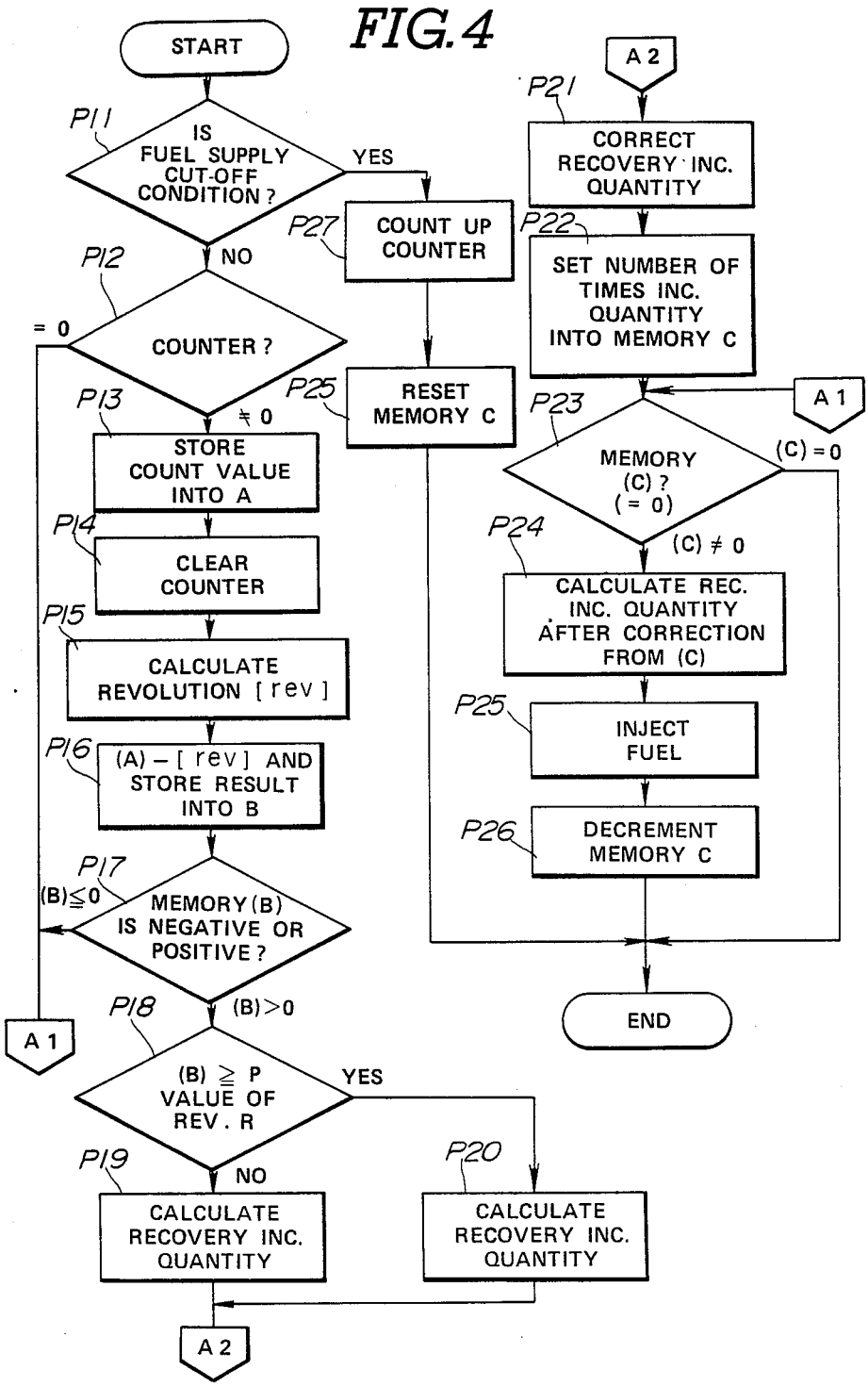
FIG. 4 is a processing flowchart of another program for controlling a fuel supply cut-off to the engine and deriving fuel injection quantity at the time of a fuel supply recovery executed in the control circuit shown in FIG. 1.

FIGS. 2 and 4 are flowcharts representing the precessing programs executed in the control circuit 16 shown in FIG. 1.

In FIGS. 2 and 4, Pi (i=1 to 26) denotes processing steps in the programs.

The processing program shown in FIG. 2 is executed once for each predetermined interval of time (for example, 100 milliseconds).

In a step P1, the control circuit 16 determines whether the engine operating condition falls in a condition under which the fuel supply cut-off should be carried out on the basis of the present engine operating condition detected by the above-described sensors.

If the present engine operating condition does not fall in the condition of no need to carry out the fuel supply cut-off, the routine goes to the steps P2 to P5 in which basic fuel injection quantities Tp stored in the memory locations (MTP1 to MTP5) are shifted toward the adjacient memory locations totally by five number of times for storing the basic fuel injection quantity Tp before 500 milliseconds (the value of 500 milliseconds will be described later). That is to say, a value in MTP4 is shifted to MTP5, that in MTP3 to MTP4, that in MTP2 to MTP3, and that in MTP1 to MTP2. Next, in the step P6, the control circuit 16 calculates the present basic fuel injection quantity Tp and stores the calculated value into MTP1. Then, the present processing shown in FIG. 2 is ended.

On the other hand, when the control circuit 16 determines that the present engine operating condition corresponds to the condition of need to carry out the fuel supply cut-off, the processing in FIG. 2 is jumped and the present processing routine is ended.

The reason of storing the basic quantity Tp at the time of 500 milliseconds before the fuel supply cut-off will be described below.

In general, the residual quantity of the supplied fuel remaining onto the intake air passage is largely varied according to a load state of the engine.

In other words, if the engine operating condition before the fuel supply cut-off is carried out is in the high engine load state, the residual quantity of fuel is increased and it takes a long time to reduce the quantity of remaining fuel. On the other hand, when the engine operating condition before fuel cut-off is carried out at low engine load, the quantity of fuel adhered to the wall of the intake passage is less and the quantity of adhered fuel is reduced at high speed.

Therefore, if the engine operating condition before the fuel supply cut-off is determined, the residual quantity of fuel can be estimated when the fuel supply cut-off is carried out. Since the residual quantity of fuel remaining onto the wall of the intake air passage itself is difficult to measure directly, the residual quantity of fuel at each engine load state described above is estimated on the basis of a characteristic graph, e.g., shown in FIG. 3 in the preferred embodiment.

It is, however, noted that although the throttle valve 6 is in a fully closed state immediately before the fuel supply cut-off and, at this time, the engine is in the low load state, the residual quantity of fuel is not abruptly reduced and the load state at that time does not exactly correspond to the residual fuel quantity. Therefore, the residual quantity of fuel at the start time of fuel supply cut-off is determined on the basis of the engine load at that time, e.g., the basic fuel injection quantity Tp at a time between 300 to 600 milliseconds (in this embodiment, 500 milliseconds) before the start of fuel supply cut-off in which the residual quantity of fuel is not relatively varied from a time at which the throttle valve 6 starts to close to a time at which the fuel supply cut-off is started.

Figure 3:
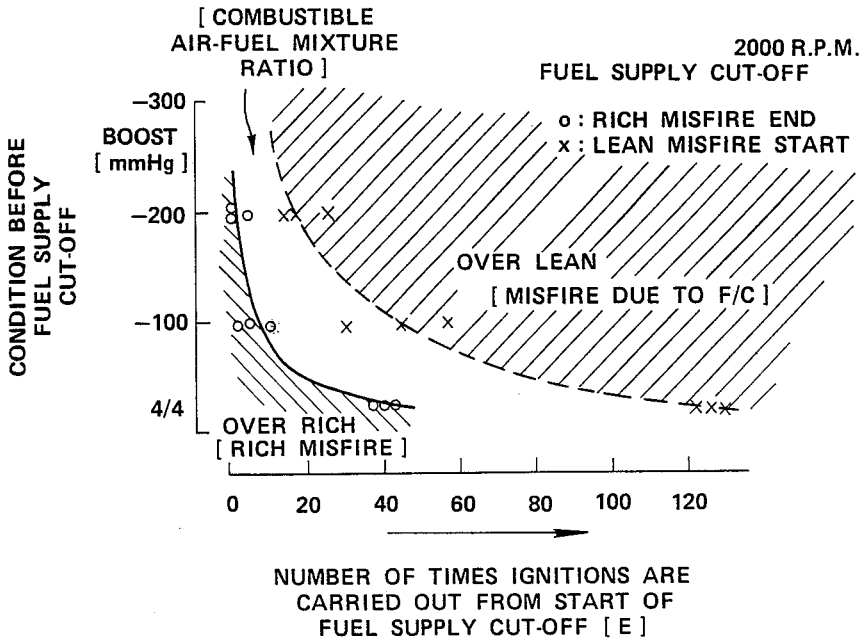
FIG. 3 is a characteristic graph representing a derivation of a residual quantity of fuel and adhered onto a wall of an intake passage of an engine shown in FIG. 1.

FIG. 3 shows the characteristic graph to derive the residual fuel quantity at the start time of the fuel supply cut-off when the engine revolution speed is 2000 r.p.m.

The residual fuel quantity expressed as d at the start time of the fuel supply cut-off is determined, in the case shown in FIG. 3, from a boosted pressure at the intake air passage downstream of the throttle valve 6 immediately before the start of the fuel supply cut-off. The boosted pressure can be detected by means of a pressure responsive sensor exemplified by a U.S. Pat. No. 4,342,230, the disclosure of which is hereby incorporated by reference, or can be estimated by the output signal of the throttle valve opening sensor 12. Experiments indicated that the residual quantity of fuel d at the start time of fuel supply cut-off was substantially inversely proportional to a square of a negative intake air pressure value denoted by p, i.e., the boosted pressure ($d \propto 1/p^2$) immediately before the fuel supply cut-off is carried out. As the intake air pressure becomes nearer to zero, i.e., to the atmosphere, the residual quantity of fuel d is remarkably increased. These matters are appreciated from a combustible air fuel mixture region shown in FIG. 3. If both the boosted pressure and the engine revolution speed Ne at which the fuel supply cut-off is carried out are determined, e.g., to be 2000 r.p.m., the residual fuel quantity d is derived in the characteristic graph shown in FIG. 3 in terms of a number of revolutions of the engine through which the residual quantity of fuel d is exhausted from the wall of the intake air passage. In the other case where the engine revolution speed at which the fuel supply cut-off is carried out indicates another engine revolutions, one of the characteristic graphs similar to that shown in FIG. 3 is used to derive the residual quantity of fuel d since the change of the engine revolution speed Ne does not largely affect the quantity of the residual fuel. in the case of FIG. 3, the number of engine revolutions [rev] based on the derived residual quantity d can be derived using the number of times engine ignitions are carried out in FIG. 3.

FIG. 4 shows the program flowchart for controlling the fuel supply cut-off executed in the fuel supply controlling system.

It is noted that the processing flowchart shown in FIG. 4 is executed once for each predetermined interval in synchronization with the engine revolution.

In a step P11, the control circuit 16 determines whether the engine operating condition falls in the condition under which the fuel supply cut-off should be carried out on the basis of the detected cooling temperature Tw, engine revolution speed Ne, and opening angle of the throttle valve TVO. If the present time is not under the fuel supply cut-off condition, the routine goes to a step P12 in which the control circuit 16 determines whether a count value counted up during the fuel supply cut-off condition indicates zero [0] (count value=0). The fuel supply cut-off condition is exemplified in U.S. Pat. No. 4,395,984 issued on Aug. 2, 1983, the disclosure of which is hereby incorporated by reference. The condition to cut off the fuel supply is, e.g., when the throttle valve 6 is fully closed (deceleration driving) and the engine revolution speed Ne is above a predetermined fuel supply cut-off start engine revolution speed (Ne equal to or more than Nc). If the count value≠0, the control circuit 16 determines that the present time is immediately after the fuel recovery is carried out (fuel supply resumption is carried out). In a step P13, the control circuit 16 stores the count value of the counter at the present time into a memory location A as the engine revolution number (representing the number of engine revolutions during which the fuel supply cut-off is carried out) [rev] from the start of the fuel supply cut-off to the time immediately after start of the fuel recovery. In the next step P14, the control circuit 16 clears the counter.

In a step P15, the control circuit 16 calculates the engine revolution numbers [rev] during which the residual quantity of fuel is consumed and which is determined on the basis of the value of MTP5 (that is to say, the basic fuel injection quantity Tp before 500 milliseconds) derived using one of the characteristic graphs, e.g., shown in FIG. 2. In a step P16, the value of subtraction of the calculated value [rev] derived in the step P15 from the value [rev] stored in the memory location A is stored in a memory location B. That is to say, in the step P16, the control circuit 16 calculates to which degree the engine revolution numbers [rev] during which the fuel supply cut-off is carried out covers the engine revolution numbers [rev] during which the residual quantity of fuel is consumed and which is derived on the basis of the residual quantity of fuel immediately before the fuel supply cut-off is carried out. Hence, the value of memory location B indicates a number of engine revolutions (or duration of time) at which number of engine revolutions (or duration of time) the fuel supply quantity starts to become insufficient when the fuel supply recovery is carried out.

It is noted that in this embodiment the number of engine revolutions [rev] during the fuel supply cut-off are calculated since the processing routine shown in FIG. 4 is executed in synchronization with the engine revolution but the present invention is not limited to the number of engine revolutions. The control circuit may calculate the duration of time during which the fuel supply cut-off is carried out since in summary an interval of time for which the residual quantity of fuel begins to become insufficient needs to be determined.

In the next step P17, the control circuit 16 determines whether the value stored in the memory location B is positive or negative. If (B)>0 (i.e., the value of memory location B is larger than a portion denoted by a solid line shown in FIG. 5), the routine goes to a step P18 in which the control circuit 16 determines whether the value of memory location B is equal to or more than a predetermined number R of engine revolutions as denoted by a portion enclosed by a broken line of FIG. 5 ((B)≧R (predetermined number of revolutions)) or not.

If (B)<R (predetermined number of engine revolution), the routine goes to a step P19 in which a fuel recovery increment quantity for increasing the fuel supply quantity at the time of start of fuel supply recovery is calculated in accordance with the following equation (1). If (B)≧R (predetermined number of revolutions) (refer to a hatched portion in FIG. 5), the routine goes to a step P20 in which a predetermined fuel recovery increment quantity at the time of no presence of the residual quantity of fuel is set as the present fuel recovery increment quantity and goes to a step P21.

Fuel recovery increment quantity $F_R=F_{RE}$ (fuel recovery increment quantity at the time of no presence of fuel residual quantity) x R−(B) (the number of revolutions exceeding B (or time duration)/R (predetermined number of engine revolutions) (or time duration) (1)

In the next step P21, the fuel recovery increment quantity $F_R$ derived in the step P19 or step P20 is corrected on the basis of the detected cooling water temperature Tw. In the next step P22, the number of times the corrections of recovery increment quantity are carried out is stored in a memory location C. It is noted that the number of times corrections of fuel recovery quantity $F_R$ are carried out is stored for preventing the quantity of fuel recovery increment $F_R$ quantity from supplying once at a time during the fuel recovery time. The number of times the corrections are carried out are set according to the degree of the corrections of the fuel recovery quantity through many experiments.

On the other hand, the control circuit 16 determines that the present time is not immediately after the start of the fuel supply recovery if counter value=0 in the step P12. The following processing is jumped to go to a step P23.

Figure 5:
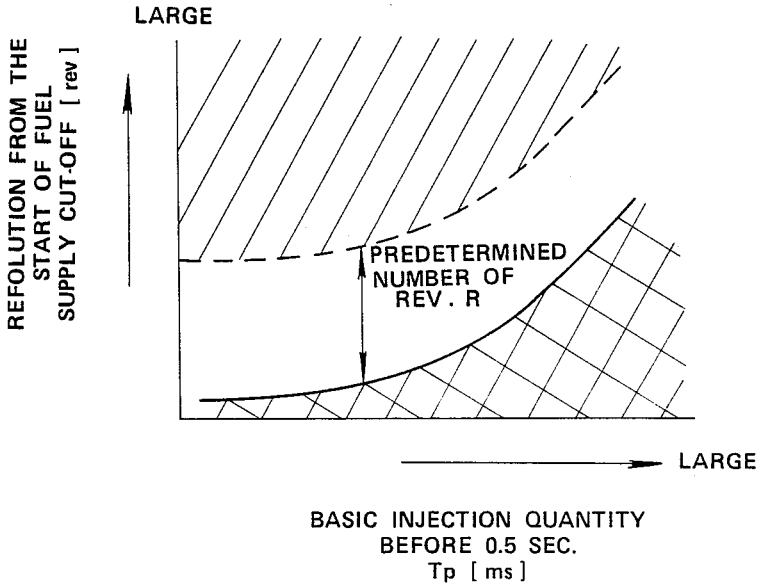
FIG. 5 is a table map representing action carried out according to an operating region when a correction of fuel recovery increment quantity at a start time at which the fuel supply recovery is carried out.

If in the step P17 (B)≦0 (i.e., the value of memory location B is smaller than the portion denoted by the solid line shown in FIG. 5), the control circuit 16 determines that even when the present time is the fuel recovery time the number of engine revolutions [rev] is below the number of engine revolutions at which the number of times the fuel cut-off begins to become insufficient (that is to say, the residual quantity of fuel immediately before the fuel supply cut-off still remains after the end of fuel supply cut-off) and the control circuit 16 does not correct the basic fuel recovery increment quantity. Then, the routine directly goes to a step P23. In the step P23, the control circuit 16 determines whether the value of memory location C is [0] ((C)=0). If (C)≠0, the routine goes to the step P24. In the step P24, the control circuit 16 derives the recovery increment quantity corrected in the step P21. The calculated value is added to the basic fuel injection quantity to provide a final recovery increment quantity. Hence, the final recovery increment quantity is gradually decreased according to the value of number of times stored in the memory location C.

In the next step P25, the fuel injection quantity calculated in the step P24 is registered in an output register in the I/O unit in the control circuit 16 and outputs an injection signal S1 to the fuel injector 7 having a pulse-width corresponding to the fuel injection duration during which the fuel injection quantity calculated as described above is supplied to the engine 1 via the fuel injector 7 at a predetermined crank angle of the engine revolution. In the step P26, the contents of memory location C is decremented and the above-described processing shown in FIG. 4 is ended.

On the other hand, when the engine is in the condition under which the fuel supply cut-off should be carried out, the control circuit 16 determines that the present time is in the fuel supply cut-off condition and the routine goes to the step P27 in which the counter is counted up. In a step P28, the memory location C is reset (C=0) and the present processing is ended.

In this way, the fuel residual quantity is calculated at the time of fuel supply cut-off start on the basis of the basic fuel injection quantity Tp representing the engine load and the quantity of fuel incremented at the time of start of fuel recovery is appropriately set according to the residual quantity of fuel and interval of time during which the fuel supply cut-off is carried out.

Hence, the fuel injection quantity at the time of start of the fuel recovery can be optimized irrespective of the amount of residual quantity of fuel before the fuel supply cut-off is carried out. Consequently, the characteristic of response to the acceleration can be improved.

It is noted that although in the preferred embodiment the present invention is applicable to the engine of the single point injection (SPI) type, the present invention is also applicable to any type of engine in which part of the air intake passage disposed from the fuel injector to each combustion chamber is long.

In addition, although the basic fuel injection quantity Tp is used to represent the engine load when the residual quantity of fuel is estimated, the present invention is not limited to the basic fuel injection quantity Tp. In place of the basic fuel injection quantity Tp, any one of the other parameters representing the engine load such as intake air pressure, engine torque, or intake air quantity Qa may be used.

As described hereinabove, since in the fuel supply controlling system and method according to the present invention the residual quantity of fuel adhered to the wall in the intake air passage is derived on the basis of the engine load immediately before the fuel supply cut-off is carried out and interval of time during which the fuel supply cut-off is carried out and the fuel recovery increment quantity is set on the basis of the derived residual quantity of fuel, the characteristic of response of the vehicle to the acceleration is remarkably improved and the driveability, exhaust emission, and fuel saving can be improved.

It will clearly be appreciated by those skilled in the art that the foregoing description is made in terms of the preferred embodiment and various changes and modifications may be made in terms of the preferred embodiment which is to be defined by the appended claims.

What is claimed is:

1. A system for controlling a fuel supply to an internal combustion engine, comprising:

(a) first means for monitoring engine operating conditions;

(b) second means for determining whether the engine presently falls in a predetermined deceleration condition on the basis of the engine operating conditions monitored by the first means and cutting the fuel supply off when it is determined that the engine presently falls in the predetermined deceleration condition;

(c) third means for calculating a basic fuel quantity to be supplied to the engine on the basis of the engine operating conditions detected by the first means and correcting the basic fuel quantity according to a fuel recovery increment quantity when the fuel supply recovery is started after the fuel supply cut-off is carried out by the second means so as to derive a final fuel quantity supplied to the engine;

(d) fourth means for deriving an engine load immediately before the fuel supply cut-off is carried out from the engine operating conditions detected by the first means;

(e) fifth means for counting a first duration of time during which the fuel supply cut-off is carried out;

(f) sixth means for deriving a residual quantity of the supplied fuel remaining on a wall of an intake air passage of the engine at a time immediately before the fuel supply cut-off is started on the basis of the engine load immediately before the engine fuel cut-off is carried out derived by the fourth means;

(g) seventh means for deriving and setting the the fuel recovery increment quantity on the basis of the residual fuel quantity and the first duration of time counted by the fifth means; and (g) eighth means for supplying the final fuel quantity derived by the third means to the engine.

2. A system as set forth in claim 1, wherein the sixth means derives the residual quantity of fuel on the basis of the basic quantity calculated by the third means in addition to the engine load at a predetermined time immediately before the engine fuel supply cut-off is carried out.

3. A system as set forth in claim 2, wherein the predetermined time falls in a range from 0.3 seconds to 0.6 seconds.

4. A system as set forth in claim 3, wherein the predetermined time is 0.5 seconds.

5. A system as set forth in claim 2, wherein the seventh means includes: ninth means for calculating a second duration of time for which the residual quantity of fuel at the predetermined time before the fuel supply cut-off is carried out becomes supplied to each combustion chamber of the engine; tenth means for calculating a subtraction of the second duration of time from the first duration of time; and eleventh means for setting the fuel recovery increment quantity when the subtraction result of the tenth means indicates positive and setting no fuel recovery increment quantity when the subtraction result indicates zero or negative.

6. A system as set forth in claim 5, wherein the seventh means further comprises twelfth means for comparing the subtraction result of the tenth means with a predetermined duration of time and the thirteenth means for varying the fuel recovery increment quantity according to the result of comparison of the twelfth means.

7. A system as set forth in claim 6, wherein the thirteenth means calculates and sets the fuel recovery increment quantity when the subtraction result is equal to or more than the predetermined duration using the following equation: $F_R = F_{RE} x R - B/R$, wherein $F_R$ denotes the fuel recovery increment quantity to be derived, $F_{RE}$ denotes a predetermined fuel recovery increment quantity when no residual fuel quantity is present, R denotes the predetermined duration, and B denotes the second duration of time.

8. A system as set forth in claim 7, wherein the thirteenth means calculates and sets the fuel recovery increment quantity which corresponds to the predetermined fuel recovery increment $F_{RE}$ when the subtraction result is lower than the predetermined duration of time.

9. A system as set forth in claim 7, which further comprises fourteenth means for correcting the fuel recovery increment quantity calculated by the thirteenth means according to one of the engine operating conditions detected by the first means for dividing the calculated fuel recovery quantity by the thirteenth means by a predetermined number so that the basic fuel quantity supplied to the engine is corrected according to the divided fuel recovery increment quantity until the supply of the fuel recovery increment quantity to the engine is ended.

10. A system for controlling a fuel supply to an internal combustion engine, comprising:

(a) first means for detecting engine operating conditions;

(b) second means for commanding a fuel supply cut-off during a predetermined deceleration condition derived on the basis of the engine operating conditions detected by the first means;

(c) third means for calculating a basic fuel injection quantity to be supplied to the engine on the basis of the engine operating conditions detected by the first means, cutting off the fuel supply to the engine upon receipt of the command from the second means, and correcting the basic fuel injection quantity according to a fuel recovery increment quantity when the fuel supply recovery is started after the fuel supply cut-off is carried out to derive a final fuel quantity supplied to the engine;

(d) fourth means for calculating an engine load immediately before the fuel supply cut-off is carried out from the engine operating conditions detected by the first means;

(e) fifth means for counting a first number of engine revolutions derived on the basis of the engine operating conditions detected by the first means, the first number of engine revolutions representing a duration of time during which the fuel supply cut-off is carried out;

(f) sixth means for estimating and calculating a residual quantity of the supplied fuel remaining on a wall of an intake air passage at a time immediately before the fuel supply cut-off is carried out on the basis of the engine load calculated by the fourth means;

(g) seventh means for setting the fuel recovery increment quantity on the basis of the derived residual fuel quantity onto the intake air passage and the first number of engine revolutions during which the fuel supply cut-off is carried out; and (h) eighth means for supplying the final fuel injection quantity derived by the third means to the engine.

11. A system at set forth in claim 10, wherein the sixth means estimates and calculates the residual quantity of fuel calculated by the third means on the basis of the engine load at a predetermined time immediately before the engine fuel cut-off is carried out.

12. A system as set forth in claim 11, wherein the seventh means comprises ninth means for calculating a second number of engine revolutions for which the residual quantity of fuel at the predetermined time immediately before the fuel supply cut-off is carried out becomes supplied to each combustion chamber of the engine; tenth means for calculating a subtraction of the second number of engine revolutions from the first number of engine revolutions; and eleventh means for setting the fuel recovery increment quantity when the subtraction result of the tenth means indicates positive and setting no fuel recovery increment quantity when the subtraction result indicates zero or negative.

13. A system as set forth in claim 12, wherein the seventh means further comprises twelfth means for comparing the subtraction result of the tenth means with a predetermined number of engine revolutions and thirteenth means for varying the fuel recovery increment quantity according to the result of comparison of the twelfth means.

14. A system as set forth in claim 13, wherein the thirteenth means calculates and sets the fuel recovery increment quantity when the subtraction result is equal to or more than the predetermined number of engine revolutions using the following equation: $F_R = F_{RE} x R - B/R$, wherein $F_R$ denotes the fuel recovery increment quantity to be derived, $F_{RE}$ denotes a predetermined fuel recovery increment when no residual fuel quantity is present, R denotes the predetermined number of engine revolution, and B denotes the second number of revolutions.

15. A system as set forth in claim 13, wherein the thirteenth means calculates and sets the fuel recovery increment quantity which corresponds to the predetermined fuel recovery increment $F_{RE}$ when the subtraction result is lower than the predetermined number of engine revolutions.

16. A system as set forth in claim 13, which further comprises fourteenth means for correcting the fuel recovery increment quantity calculated by the thirteenth means according to one of the engine operating conditions detected by the first means and fifteenth means for dividing the calculated fuel recovery quantity by the thirteen means by a predetermined number so that the basic fuel injection quantity to be supplied to the engine is corrected according to the divided fuel recovery increment quantity until the supply of the fuel recovery increment quantity to the engine is ended.

17. A system as set forth in claim 16, wherein the first means detects an engine cooling water temperature as one of the engine operating conditions so that the fourteenth means corrects the fuel recovery increment quantity according to the detected engine cooling water temperature.

18. A system as set forth in claim 16, wherein the eighth means comprises a single fuel injector which injects the final fuel injection quantity derived by the third means whenever a predetermined crank angle detected by the first means after the fuel supply cut-off is carried out is reached.

19. A method for controlling a fuel supply to an internal combustion engine, comprising the steps of:

(a) monitoring engine operating conditions;

(b) cutting off a fuel supply during a predetermined engine deceleration condition derived on the basis of the engine operating conditions monitored in the step (a);

(c) calculating a basic fuel quantity to be supplied to the engine on the basis of the engine operating conditions detected in the step (a);

(d) deriving an engine load immediately before the fuel supply cut-off is carried out from the engine operating conditions detected in the step (a);

(e) estimating a residual quantity of fuel adhered onto a wall of an intake air passage of the engine at a time immediately before the fuel supply cut-off is carried out on the basis of the engine load derived in the step (d);

(f) setting a fuel recovery increment quantity to be supplied to the engine after the fuel supply cut-off is carried out on the basis of the residual quantity of fuel and interval of time for which the fuel supply cut-off is carried out in the step (b);

(g) correcting the basic fuel quantity according to the set fuel recovery increment quantity to derive a final fuel quantity supplying to the engine; and (h) supplying the final fuel quantity derived in the step (g) to the engine through fuel supplying means.

* * * * *